United States Patent [19]

Rainer et al.

[11] 4,022,223

[45] May 10, 1977

[54] SMOKING ARTICLE

[75] Inventors: Norman B. Rainer; Charles B. Hoelzel, both of Richmond, Va.

[73] Assignee: Philip Morris Incorporated, New York, N.Y.

[22] Filed: July 26, 1973

[21] Appl. No.: 382,952

[52] U.S. Cl. ..... 131/10.9; 131/267

[51] Int. Cl.[2] ..... A24D 1/06

[58] Field of Search ..... 131/10, 10.5, 10.7, 131/10.9, 9, 261, 262, 267, 269

[56] References Cited

UNITED STATES PATENTS

| | | | |
|---|---|---|---|
| 2,815,760 | 12/1957 | Schreus et al. | 131/208 |
| 3,046,994 | 7/1962 | Schur | 131/10.9 |
| 3,340,879 | 9/1967 | Horsewell et al. | 131/269 X |
| 3,410,282 | 11/1968 | Walker et al. | 131/267 |
| 3,724,469 | 4/1973 | Reynolds et al. | 131/266 |

FOREIGN PATENTS OR APPLICATIONS

| | | | |
|---|---|---|---|
| 6,503,794 | 3/1955 | Netherlands | 131/10 R |

OTHER PUBLICATIONS

"Chelating Agents and Metal Chelates," By Dwyer et al., Academic Press New York & London 1964.

*Primary Examiner*—Robert W. Michell
*Assistant Examiner*—V. Millin

[57] ABSTRACT

Selected heavy metal compounds, particularly copper or nickel in the form of their salts, may be complexed with selected aliphatic or aromatic amines and deposited on a solid support or substrate to provide a material for the detection and/or removal of HCN from a mixture of gases; removal from tobacco smoke being particularly desirable. Certain novel compositions are also provided.

8 Claims, No Drawings

SMOKING ARTICLE

BACKGROUND OF THE INVENTION

It has been stated in various publications, for example in a Scholler article in Chem. Zentr. 1939; 11, p. 1402–3, and in an article reported in CA 50, 8143*d*, Osborne et al, Anal. Chem. Vol. 28, pp. 211–215 (1956), that tobacco smoke may contain small amounts of hydrogen cyanide. Two patents to Keith, U.S. Pat. Nos. 3,251,365 and 3,460,543, and Litzinger, U.S. Pat. No. 3,716,063 also mention the presence of hydrogen cyanide in tobacco smoke and the Keith patents further discuss the possible effects of this gas from a physiological standpoint.

Selective removal of hydrogen cyanide from cigarette smoke by means of special filter compositions has been proposed on various occasions. Alkaline additives such as alkali metal carbonates and the like have been applied to conventional filter materials in efforts to remove or absorb any hydrogen cyanide contained in tobacco smoke. Activated carbonaceous material with a surface treatment of copper oxide has also been proposed for hydrogen cyanide removal. In Keith et al patent, U.S. Pat. No. 3,251,365 and in another Keith patent, U.S. Pat. No. 3,460,543, the use of various metal oxides, namely oxides of cobalt, copper, zinc or iron, on a carrier for removal of hydrogen cyanide is disclosed. In a more recent patent, Horsewell et al, U.S. Pat. No. 3,550,600, zinc acetate in admixture with an organic or inorganic base on a smoke filter paper or cellulose acetate filter support is described as being effective in the removal of various gaseous components, including hydrogen cyanide, from tobacco smoke. In the Horsewell et al patent, the examples given indicate a reduction of from about 57% to as high as 85% of the original hydrogen cyanide concentration in the tobacco smoke.

An object of the present invention is to provide a method and means for the colorimetric detection of cyanides.

Another object of the present invention is to provide a method and means for selectively removing cyanides, and particularly hydrogen cyanide, from gases.

A further object of the present invention is to provide a method and means for removing a major amount of any hydrogen cyanide which may be present in tobacco smoke.

A still further object of the present invention is to provide novel compositions of matter having utility as selective filtrants for cyanides from other gases.

These and still other objects will be discussed more fully in the description of the invention which follows.

Description of the Invention

This invention relates to the treatment of gaseous substances containing hydrogen cyanide. More particularly the present invention is concerned with a method and means for the detection and/or selective removal of hydrogen cyanide from gases such as tobacco smoke.

It has been discovered that certain heavy metal salt-amine complexes deposited on suitable bases are highly effective in absorbing or removing substantial amounts of hydrogen cyanide contained in various gas mixtures, including any hydrogen cyanide which may occur in the smoke of tobacco or a tobacco substitute. It has also been discovered that the removal of the cyanide component from tobacco smoke by special metal-amine complexes may concurrently release a portion of the amine constituting part of the complex into the smoke stream. Moreover, incident to exposure to cyanides, the present metal salt-amine complexes undergo a readily observable color change which serves as an indicator of the presence of such poisonous substances.

The compositions employed in accordance with the present invention are prepared by reacting a salt of a transition metal with an organic amine to produce a metal-amine complex. The complex may be formed in situ on a suitable filter base or may be formed and then added thereto.

The transition metals which may be employed in the present invention are preferably selected from the members of the third period elements, and of these, copper, nickel, iron, cobalt and manganese appear most desirable.

It is not necessary that the foregoing metals be employed in any particular cationic form. It has been discovered, however, that divalent nickel salts and either monovalent or divalent copper salts are particularly active and, consequently, salts comprising these cations represent a most preferred embodiment of the present invention.

It has been determined that the anionic portion of the present metal salts has essentially no effect on the utility of the present complexes. It is desirable that the salts be soluble in water or aqueous ammonia, however, and of these, the chlorides are particularly preferred. Other salts - containing sulfate, nitrate, phosphate, and hydroxyl anions - are also effective. Similarly, metallic salts formed from organic acids having 1 to about 12 carbon atoms may also be used in forming the metal salt-amine complexes, and of these the formate and acetate ions are most efficacious.

There are essentially no limits as to the amines which may be employed in forming the present metal-salt-amine complexes. A particularly desirable class of amines, however, includes those amines having a vapor pressure below about 0.01 mm. Hg. at 20° C. Examples of such substantially non-volatile amines are triethylenetetramine, iminobispropylamine, tetraethylenepentamine, pentaethylenehexamine, diethanolamine, triethanolamine, N-aminoethyl ethanolamine, N-methyl diethanolamine, tri-isopropanolamine, N-(3-aminopropyl) morpholine, N-(2-hydroxyethyl) piperazine, hexamethylenetetramine, polymers of ethylenimine or polyvinyl amine having molecular weights of from about 450 to about 60,000, and amino acids such as glycine, alanine, phenylalanine, proline, lysine, histidine and the like. Where amines of this non-volatile class are employed in accordance with the present invention, little or no amine has been found in the smoke stream and it has therefore been assumed that it has been retained on the carrier. Such a result has the advantage that the only apparent effect on the filtered smoke itself is the removal of detrimental cyanide components. A preferred class of amines comprises those amines soluble in water to the extent of at least 10 weight percent.

The reaction of the metal salt with the complexing amine is carried out with a molar excess of the amine, preferably at a molar ratio, amine to metal salt, of at least 3 to 1 and more preferably at a ratio of at least 4 to 1. The reaction is preferably carried out in a solvent for both the reactants and the complex product. The reaction is a straight forward addition of the complexing amine to the salt of the heavy metal. Where the complex is soluble in the solvent medium used, any precipitate that is formed may be separated by the usual procedures — for example, by filtration or decantation — and the complex obtained from the remaining solution by evaporation or distillation of the solvent.

The solvent may be any liquid medium in which the reactants are soluble, such as water, aqueous ammonia, lower alkanols or even the liquid amine itself. Preferably, the complex formed is also soluble in the reaction medium as impurities in the form of precipitates may then be removed easily and the complex obtained by such usual solvent removal procedures as evaporation. In the event that the complex formed is insoluble in the reaction solvent medium, or crystallizes out, it may be separated from the supernatant — for example, by filtration — washed and, if desired, purified further.

Temperature conditions for effecting the reaction are mild. The reaction will proceed satisfactorily at room or ambient temperatures or at any temperature of from about 0° to about 90° C.

If the metal salt-amine complex or addition product is prepared in a liquid reaction medium, it may be concentrated and then absorbed onto a substrate or carrier capable of acting as a support for the dry metal salt-amine complex. After deposition of the complex, the product is then dried by various known procedures.

The preparation of the desired metal salt-amine complex may also be carried out in situ on the surface of the carrier or where it is to be used. In such a case, one may apply a solution of one of the reactants, for example of the metal salt, to the carrier, dry at a temperature of up to about 100° C and then introduce the second reactant, for example the amine, either undiluted or in solution, a period of about a few minutes to about one hour being allowed to permit the complex to form before drying the composition. The solvents for the separate solutions may be any of those mentioned for carrying out the reaction. The temperature conditions required for forming a metal-amine complex by in situ deposition and reaction will range from about 0° C to about 90° C, but should not exceed the decomposition temperature of any component or product.

Where the complex is applied to a support or substrate from solution, it is obvious that the solvent should be relatively volatile so that it may be easily evaporated and removed from the solid substrate. Water, acetone, or a lower alkanol of from 1 to about 4 carbon atoms are particularly suitable for this purpose.

The complexes formed in accordance with the foregoing processes generally exhibit a metal to coordinated amine group mole ratio of about 1:1 to 1:4. This ratio does not, however, reflect the presence of additional amine groups which may be present in the amine ligand, but which, for steric or other reasons, are not co-ordinated with the metal. Thus, for example, where polymers such as those of ethylenimine are employed, there will ordinarily be an excess of amine groups beyond those required to fully complex the metal salt.

Where the complex on the supporting substrate is to be utilized in a cigarette filter to remove or sequester the cyanide component in the main stream tobacco smoke, one may employ a cellulosic cigarette filter paper as the substrate. Such paper is generally sufficiently absorbent to take up the desired amount of the solubilized complex. Alternatively, one may use a typical cigarette filter material such as cellulose acetate filaments of 1.5 to 5 denier as the substrate. These filaments are capable of retaining the solid complex in sufficient quantity to permit adequate contact of the complex with the main stream smoke so as to remove any cyanide component from the gaseous fractions. In general, the preferred substrates are of the porous variety, particularly those having a surface area greater than 0.4 square meter per gram, most preferably greater than 1.0 square meter per gram.

Other supporting materials that may be used are activated carbon, charcoal or a molecular sieve such as that produced by the Linde Division of Union Carbide Corp. and identified as Linde Type 5A. Additionally, a microporous polymeric product of vinyl chloride, preferably those types described in a Johnson et al patent, namely U.S. Pat. No. 3,528,433, has also proven extremely effective.

Another and particularly useful substrate for the complex is granular activated alumina having a "BET" surface area of about 200 $m^2/g$ such as that sold by the Reynolds Chemicals Division of Reynolds Metals Co., Richmond, Va., and which is identified as a type RA-1 activated alumina.

The deposited metal salt-amine complex may be present in the supporting material in an amount of about 0.1% to about 40%, preferably 1 to 10%. The complexes generally have a green, blue or purple color and, as cyanide is absorbed, become colorless. This provides a visual indication of the extent of utilization of the complexes. The color change is most apparent when the complex is carried on a white substrate.

This color change in the metal salt-amine complex additionally provides a useful means for detecting the presence of cyanides in gaseous or liquid medium. Thus the complex — supported by a carrier or not — may be utilized as a detector to warn of the necessity of employing a filtering device such as the gas mask more fully described below. Although mere visual inspection of complex is adequate for detection of cyanides in a fluid, this invention also encompasses the use of complementary apparatus — for example, a conventional colorimetric device which would register any decrease in the absorbence of the complex at its characteristic wavelength — so as to automate the detector or to convert it into a quantitative measuring device.

It has additionally been discovered that where the substrates — for example granular microporous polyvinylchloride — of the present complexes normally exhibit poor bulk flow characteristics due to interparticle electrostatic attraction, incorporation of such complexes unexpectedly improves these characteristics. Thus, one advantage inherent in the present complexes resides in their propensity to reduce the usual handling difficulties common to any particulate material capable of retaining an electrostatic charge and the specific flow problems attendant to forming cigarette filters with members of the present class of substrates.

Cigarette filters may be improved considerably by incorporating therein the instant metal salt-amine complex described above because, as has already been pointed out, the complexes of this invention are particularly effective in removing practically all of the cyanide ion, whether in the form of hydrogen cyanide or as organic cyanides, found in the gas phase of tobacco smoke. As much as 90% to 100% of the hydrogen cyanide in the tobacco smoke may be removed with the compositions of the invention. Moreover, the concurrent color change may be made readily observable — for example at the filter end or through a transparent peripheral panel — so as to assure the smoker of increased protection against harmful smoke components.

The metal salt-amine complexes of this invention — whether supported by a carrier or not — are also valuable in other embodiments such as filtering means for gas masks. Thus where hydrogen cyanide may be present, for example when such compound is used in a chemical reaction or is released as a by-product of a chemical reaction, such masks would provide important protection against harmful exposure.

Finally, the polyethylenimine complexes of the present metal salts have utility beyond their use in cigarette and other gas filtering embodiments. They are film formers and provide coatings which are electrostatic-inhibiting or electrically conducting. Thus resin powders treated with from about 1 to 20% by weight, preferably about 5 to 10% of such complexes may show improved flow, due to alteration in electrostatic interaction.

The following examples are illustrative:

EXAMPLE 1

Cuprous chloride (0.99 g, 0.01 mole) and triethanolamine (5.19 g, 0.035 mole), the latter being intentionally in excess, were dissolved in 100 ml. of methanol. The mixture was shaken well, filtered, and allowed to stand for 3 days. Small green crystals were deposited. Analysis of these by atomic absorption spectroscopy showed 28.0% Cu; calculated for 1:1 complex, 25.60%. Elemental analysis was as follows:

| Element | Found | Calculated |
|---|---|---|
| C | 28.98 | 29.04 |
| H | 5.95 | 6.09 |
| N | 5.60 | 5.64 |
| Cl | 14.47 | 14.29 |

A sample (160 mg) of the green crystals was dissolved in 25 ml of water giving a blue solution. The addition of 22.35 ml of 0.1134 M KCN (2.534 millimoles) discharged the blue color. This gives an equivalent weight for the sample of 63.13 (calculated 62.05), when one assumes a trivalent cuprocyanide ion formed such as $Cu(CN)_4$ .

EXAMPLE 2

Cuprous chloride (20.0 g, 0.20 mole) was dissolved with stirring in 250 ml of concentrated $NH_4OH$ (the ammonia effectively prevented hydrolysis and redox reactions). Polyethylenimine (Dow Chemical Co., PEI-18, mol wt approx. 1800), 34.8 g, or 0.80 formula wt equivalent, was dissolved in 100 ml of water and added all at once to the first solution. The mixture was stirred for three hours, then transferred to an evaporating dish and allowed to dry under ambient conditions. The material was taken up in methanol, filtered to remove insoluble materials and then evaporated to dryness. Further drying in vacuo over $P_2O_5$ yielded 59.2 g of blue, friable glass; copper analysis, 20.2%.

Other preparations similar to that described gave products with copper contents ranging from 12 to 19%, most being 15% to 18%.

A solution of 1 g of the glassy product in 30 ml of water was prepared and 10 ml of the solution was used to impregnate 5.00 g of 40 to 80 mesh activated alumina (Type RA-1 from Reynolds Chemicals). Filtration and drying in vacuo over $P_2O_5$ yielded 5.19 g of light blue material containing 3.7 wt % of the complex. This was re-sieved to 40 to 80 mesh before use in cigarettes. Similar impregnation of microporous polyvinyl chloride was done.

EXAMPLE 3

Using the procedure of Example 1, the following cupric, ferric, ferrous, manganous, nickelous, and cobaltous chlorides or their hydrates were converted to their triethanolamine complexes. Each salt was dissolved in methanol, at least two moles of triethanolamine was added, and the solution was filtered. The filtrate was used to impregnate a microporous polyvinyl chloride (PVC) support which was dried and used in cigarette filters.

EXAMPLE 4

The supported complexes prepared in Example 3 were evaluated in cigarette filters by filling an 8 mm space and attaching the filters to 65 mm rods. Test smoking showed the following reductions from the delivery of a control cigarette:

| Metal Cation | % Reduction HCN |
|---|---|
| $Cu^{+}$ | 100 |
| $Cu^{++}$ | 91 |
| $Ni^{++}$ | 90 |
| $Fe^{+++}$ | 44 |
| $Co^{++}$ | 36 |
| $Mn^{++}$ | 17 |

It will be noted that the cuprous, cupric and nickelous cations were the most effective.

EXAMPLE 5

Activated alumina and microporous PVC carriers impregnated with cuprous - PEI complex prepared as described in Example 2 were loaded into the 8 mm long space between two short cellulose acetate filter plugs (a "plug-space-plug" filter) and the filters were attached to standard 65 mm commercial cigarette rods. These cigarettes were smoked and the gas phase was subjected to infrared analysis.

The reduction of certain gas phase components vs. the reduction of cyanide is tabulated below to show the relative selectivity for HCN:

| Carrier | Complex mg/cigt | % Reduction HCN | Acetaldehyde | Isoprene |
|---|---|---|---|---|
| Microporous PVC | 25 | 88 | 36 | 8 |
| Activated Alumina | 10 | 92 | 21 | (−5) |

EXAMPLE 6

Nickel chloride hexahydrate (57.5 g, 0.20 mole) was dissolved in 200 ml of water. A solution of polyethylenimine 18 (PEI-18, 34.8 g, 0.8 nitrogen equivalents) in 100 ml of water was added quickly with vigorous stirring. The light-green nickel solution turned deep blue. The solution was transferred to an evaporating dish and allowed to evaporate to dryness. The glassy solid thus obtained was crushed and further dried under vacuum to yield 80.6 g of blue material.

Nickel analysis: 15.50%, expected 19.3%.

One gram of $NiCl_2$/PEI-18 complex was dissolved in 30 ml of water. This solution was used to impregnate a 5.000 g sample of 40/80 mesh alumina (Type RA-1).

The alumina was filtered, freed of excess liquid, and dried under vacuum over $P_2O_5$. The alumina adsorbed 2.5% (added weight) of the complex. A CuCl/PEI-18 complex was similarly adsorbed onto alumina (3.7% added weight).

Each of the two samples was loaded into a plug-space-plug filter and mounted on a standard cigarette rod. The assembled cigarettes were smoked and analyzed for HCN removal by comparison with the standard.

| Composition | Loading | RTD | HCN Removal |
|---|---|---|---|
| Standard cigarette | — | 5" | — |
| CuCl/PEI-18 | 150 mg. | 5" | 87.5% |
| $NiCl_2$/PEI-18 | 200 mg. | 4.9" | 87.5% |

EXAMPLE 7

A granular microporous polyvinylchloride cigarette filter material prepared in accordance with Example 1 of U.S. Pat. No. 3,528,433 was divided into two equal portions. One sample — designated A — was maintained as a control, and the second — designated B — was spray-treated with an ethanol solution of the cuprous chloride-polyethylenimine complex of Example 2. After incorporation of 7% by weight of the complex, sample B was dried in a vacuum oven at 30° C to remove the ethanol.

The two samples were then measured in accordance with ASTM specification D 1895–67T, Method A, to determine their relative bulk flow characteristics. In carrying out the test, a stainless steel funnel having a 0.95 cm diameter opening at the bottom was stoppered and then filled to overflowing with a sample. The top of the funnel was then scraped off level with a straight edge. The bulk flow measurement could then be taken by recording the time required — after opening of the funnel's stoppered bottom — for emptying the funnel.

For sample A, this emptying time was 35 sec.; for sample B, 22 sec. Accordingly, the shortened measure for the treated filter material established the effectiveness of the complex for improving the bulk flow properties of particulate materials normally capable of retaining an electrostatic charge.

What is claimed is:

1. A smoking article comprising a tobacco or tobacco-substitute portion and a smoke filtering portion therefor, said smoke filtering portion containing a filtering element and a metal salt-amine complex wherein the amine of the complex is a non-volatile amine having a molecular weight of from about 450 to about 60,000 and having a vapor pressure below about 0.01 mm. Hg. at 20° C., said metal salt being soluble in water or aqueous ammonia and said metal salt-amine complex exhibiting a mole ratio of metal cation to co-ordinated amine radical of about 1:1 to about 1:4, said complex being incorporated in said smoke filtering portion in an amount from about 0.1% to 40% by weight thereof, the cation of said metal being selected from the group consisting of copper, nickel, iron, cobalt, manganese and mixtures thereof.

2. The article of claim 1, wherein the filtering portion comprises a filter base carrier having a surface area greater than 0.4 square meter per gram.

3. The article of claim 1, wherein the anionic portion of the metal salt is selected from the group consisting of chloride, sulfate, nitrate, phosphate, and hydroxl ions, organic acid ions having from 1 to about 12 carbon atoms, and mixtures thereof.

4. The article of claim 3, wherein the metal salt of the complex is selected from the group consisting of cuprous chloride, cupric chloride and nickelous chloride and the amine is a polyalkylenimine having a molecular weight of from about 450 to about 60,000.

5. The article of claim 1, wherein the cation of said metal salt is copper.

6. The article of claim 1, wherein the cation of said metal salt is nickel.

7. The article of claim 1, wherein the cation of said metal salt is selected from the group consisting of copper, nickel and mixtures thereof.

8. The article of claim 2, wherein the metal salt of the complex has a cation selected from the group consisting of divalent ion of copper, of nickel, monovalent ion of copper, and mixtures thereof.

* * * * *

UNITED STATES PATENT AND TRADEMARK OFFICE

CERTIFICATE OF CORRECTION

PATENT NO. : 4,022,223

DATED : May 10, 1977

INVENTOR(S) : N. B. Rainer and C. B. Hoelzel

It is certified that error appears in the above-identified patent and that said Letters Patent are hereby corrected as shown below:

Column 1, line 7, "50" should read --50--.

Column 2, lines 11 and 12, "in situ" should read --in situ--.

Column 3, lines 28 and 39, "in situ" should read --in situ--.

Column 5, line 40, "M" should read --M--.

Column 5, line 44, "$Cu(CN)_4$" should read --$Cu(CN)_4^{\equiv}$--.

Column 5, lines 58 and 67, "in vacuo" should read --in vacuo--.

Column 8, line 17, "metal being" should read --metal salt being--.

Signed and Sealed this

*Twentieth* Day of *June 1978*

[SEAL]

*Attest:*

RUTH C. MASON
*Attesting Officer*

DONALD W. BANNER
*Commissioner of Patents and Trademarks*